United States Patent [19]

Vessels

[11] 4,248,381

[45] Feb. 3, 1981

[54] AGRICULTURAL SPRAY NOZZLE WITH FLUID OPERATED ORIFICE CLEANING MEMBER

[76] Inventor: John B. Vessels, Rte. 1, Box 69, Webster, Ky. 40176

[21] Appl. No.: 4,617

[22] Filed: Jan. 18, 1979

[51] Int. Cl.³ ..... B05B 15/02

[52] U.S. Cl. ..... 239/118; 239/DIG. 19

[58] Field of Search ..... 239/114–118, 239/123, DIG. 19; 222/149

[56] References Cited

U.S. PATENT DOCUMENTS 2,614,885 10/1952 Roell et al. ..... 239/118

FOREIGN PATENT DOCUMENTS 6901 of 1903 United Kingdom ..... 239/118

*Primary Examiner*—Andres Kashnikow

[57] ABSTRACT

A device that is capable of unclogging a sprayer nozzle from the operator's platform and also acts as a no drip device and is capable of performing said operations in the presence of abrasion, corrosive action, and the buildup of dried material found in the use of agricultural spray materials.

5 Claims, 2 Drawing Figures

AGRICULTURAL SPRAY NOZZLE WITH FLUID OPERATED ORIFICE CLEANING MEMBER

BACKGROUND

This invention relates to farmer's crop and field sprayers and is particularly directed at the health hazard of body contact with hazardous chemicals encountered when unstopping clogged nozzles.

Ordinarily one must carry a small wire or similar tool which is used as a punch and is poked through the orifice in the spray nozzle tip. Often the nozzle must be removed from the nozzle holder assembly because the stoppage is poked inwardly and not removed and will attempt to pass through the orifice again. With this method, one must come in direct contact with the material being applied.

SUMMARY

This invention has as it's object a punch affixed to a diaphragm located in the nozzle holder assembly. The position of the diaphragm and the action of the punch is controlled by the spray pressure and it is directed by a directional valve which is located within easy reach of the operators platform.

The punch mentioned above is forced through the orifice in the spray nozzle by the same pressure which causes the nozzle to spray except that the pressure is removed from below the diaphragm and applied above the diaphragm. Also any drip is stopped.

DESCRIPTION

Figure 1:
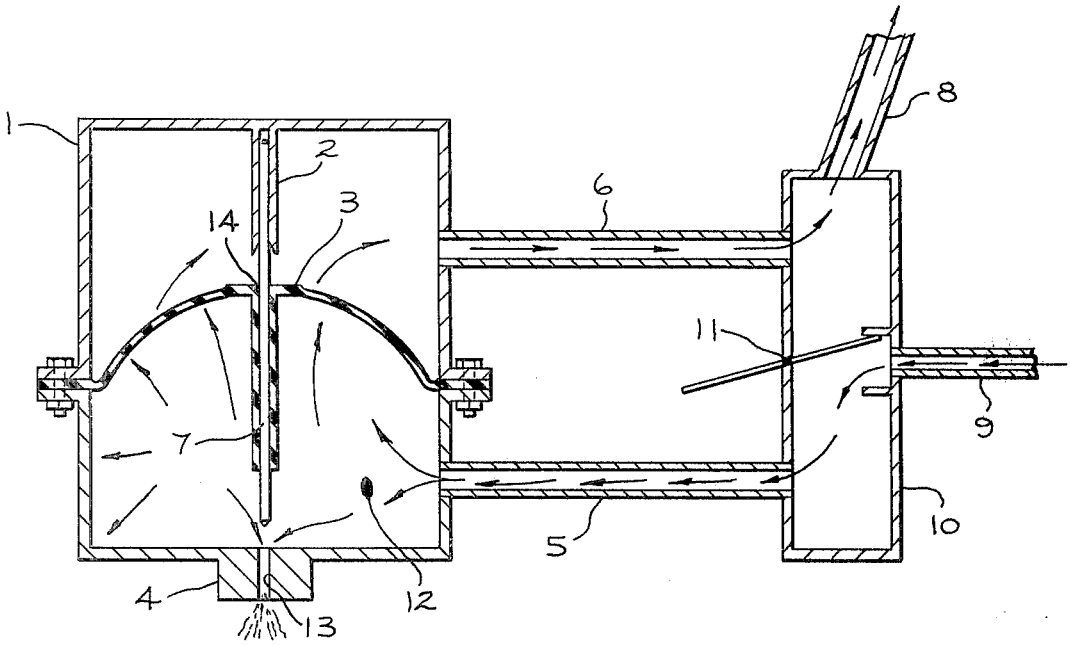
FIG. 1 is a cross section of the improved nozzle holder and nozzle assembly in the spraying position.

Because of the chemical makeup and impurities contained in agricultural spray materials and because pond water, water from streams, or other impure or dirty water is often used in the dilution of agricultural spray materials, the diluted, ready to apply, product is often contaminated with abrasive particles, corrosive action, a buildup of solid or semisolid materials when dried, adhesion, or other undesirable materials or characteristics.

Any close-fitting moving parts are subject to succumb to the increased resistance produced by the presence of the above named impurities present in areas possessing small clearances.

The parts in my device are designed to maximize power and to minimize resistance.

The punch 7 is slightly smaller than the diameter of the nozzle orifice 13, but large enough in diameter to force any material outward and away from the nozzle orifice 13 and fits said orifice 13 tightly enough to minimize dripping when inserted in said orifice 13.

The punch 7 is solid in construction and is of the same diameter at all points along its length and is small in relation to the area of the diaphragm 3 giving the diaphragm-punch unit a high power to resistance ratio.

The guide 2 is located at the opposite end of the nozzle holder assembly 1 from the nozzle 4 in order to allow free movement of the central diaphragm-punch connection 14.

FIG. 1 shows the nozzle holder and nozzle assembly with the directional valve in the spray position. In this position the directional control lever 11 is positional so the flow of spray material is directed through hose 5 directly to the nozzle and is sprayed in a normal fashion.

Figure 2:
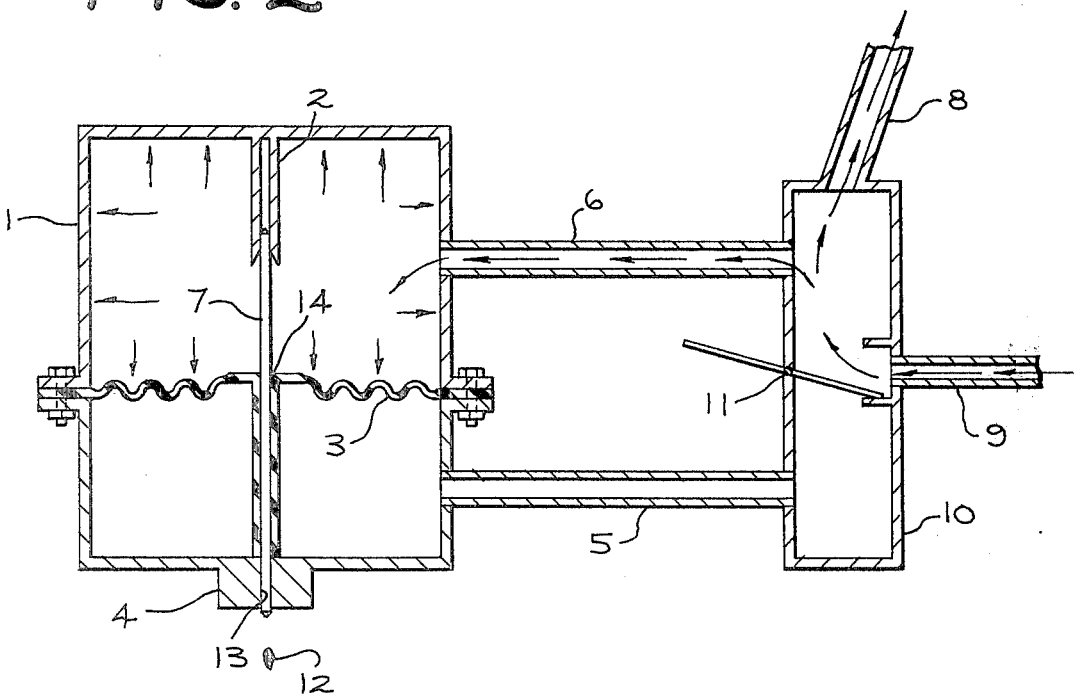
FIG. 2 is a cross section of the improved nozzle holder and nozzle assembly in the unclogging and no-drip position.

If in the act of spraying the nozzle orifice 13 becomes clogged with some solid foreign material 12 (FIG. 2) the direction control lever 11 is moved to the position shown in FIG. 2. At this point in time the direction of spray material flow is directed through hose 6 enters nozzle holder assembly 1 above the diaphragm 3 and forces diaphragm 3 down and punch 7 down through nozzle orifice 13 knocking debris 12 free and removing it from the nozzle orifice 13.

The operator returns the directional control lever 11 to spray position (FIG. 1) and the spray material begins to flow through hose 5. In order for the diaphragm punch assembly to return to spray position the pressure above the diaphragm must be released. This is done by return hose 8 which returns to the tank. Number 2 is a guide to keep punch 7 aligned with orifice 13. No. 10 is a schematic drawing of the directional control valve. The punch 7 is made of stainless steel, nylon, brass or some material tolerant of the material being sprayed as all parts should be. The diaphragm is to be of a flexible material tolerant of the materials to be sprayed. The directional valve 10 can be used as the on-off valve while turning at row ends and will provide a cleaning and no-drip function each time it is used.

Number 4 is the nozzle. This may be made as part of number 1 or it may be a replaceable tip as it will receive more wear than the other parts. Whether or not number 4 is replaceable is not meant to be vital to the spirit and scope of my invention.

Number 9 is the pressure line from the sprayer pump which supplies all pressure and volume of spray material to the inlet port on the directional control valve 10.

I claim:

1. An agricultural spray device comprising: an upper pressure chamber and a lower pressure chamber, said chambers being divided by a diaphragm, said lower pressure chamber including a nozzle having an outlet orifice; a source of spray material; a first conduit means connecting said source with said chambers; valve means in said first conduit means for controlling the flow of material to either the upper or the lower chamber; a second conduit means connecting said upper chamber with said source for allowing material to flow out of said upper chamber to said source when said valve means is directing fluid to said lower chamber; and a punch affixed to said diaphragm, said punch having a diameter slightly smaller than said orifice and being movable in and out of said orifice so as to punch out any dirt or foreign material tending to clog said orifice, said punch also minimizing dripping when in said orifice, said punch being movable into the orifice when said valve means allows material to flow to said upper chamber, said punch being movable out of said orifice when said valve means allows flow of material to said lower chamber.

2. An agricultural spray device as recited in claim 1 wherein said punch extends beyond said orifice when moved into said orifice, and being of substantially the same diameter throughout its length.

3. An agricultural spray device as in claim 1 or 2 and further including a cylindrical guide located within the upper chamber and opposite the nozzle, said guide surrounding at least a portion of said punch regardless of the position of the punch with respect to the orifice, said guide guiding the punch so as to ensure that the punch enters the orifice when material is supplied to the upper chamber.

4. An agricultural spray device as in claims 1 or 2 wherein said device is made out of a corrosion and rust resistant material.

5. An agricultural spray device as in claim 3 wherein said device is made out of a corrosion and rust resistant material.

* * * * *